US005346530A

United States Patent [19]

Miller et al.

[11] Patent Number: 5,346,530

[45] Date of Patent: Sep. 13, 1994

[54] METHOD FOR ATOMIZING LIQUID METAL UTILIZING LIQUID FLOW RATE SENSOR

[75] Inventors: Steven A. Miller, Amsterdam; Neil A. Johnson, Schenectady, both of N.Y.

[73] Assignee: General Electric Company, Schenectady, N.Y.

[21] Appl. No.: 42,911

[22] Filed: Apr. 5, 1993

[51] Int. Cl.[5] ..... B22F 9/00

[52] U.S. Cl. ..... 75/331; 75/338; 266/78

[58] Field of Search ..... 75/331, 338; 266/78

[56] References Cited

U.S. PATENT DOCUMENTS

| | | | |
|---|---|---|---|
| 4,484,059 | 11/1984 | Lillquist | 219/130.01 |
| 4,619,845 | 10/1986 | Ayers et al. | 427/422 |
| 4,631,013 | 12/1986 | Miller | 425/7 |
| 4,656,331 | 4/1987 | Lillquist et al. | 219/121 PL |
| 4,687,344 | 8/1987 | Lillquist | 374/124 |
| 4,778,516 | 10/1988 | Raman | 75/0.5 C |
| 4,780,130 | 10/1988 | Raman et al. | 75/0.5 C |
| 4,801,412 | 1/1989 | Miller | 264/12 |
| 5,047,612 | 9/1991 | Savkar et al. | 219/121.47 |
| 5,176,874 | 1/1993 | Mourer et al. | 266/80 |
| 5,259,593 | 11/1993 | Orme et al. | 266/78 |

OTHER PUBLICATIONS

"The Intelligent Control of an Inert-Gas Atomization Process", S.A. Osella, S.D. Ridder, F.S. Biancaniello, P.I. Espina, JOM, pp. 18-21, Jan. 1991.

"Flow Mechanisms in High Pressure Gas Atomization", I.E. Anderson, R.S. Figliola, H. Morton, Materials Science and Engineering, A148 (1991) pp. 101-114.

Marketing Literature, Computer Instruments Corporation, 1000 Shames Drive, Westbury, New York 11590.

*Primary Examiner*—Upendra Roy

*Attorney, Agent, or Firm*—R. Thomas Payne; James Magee, Jr.

[57] ABSTRACT

A method and apparatus for atomizing liquid metal are disclosed. A vessel supplies liquid metal through a pouring channel to an atomizing nozzle. A flow sensor provides at least one gas flow into the liquid metal, and determines a pressure difference from the gas flow. A processor determines the liquid metal flow rate through the nozzle from the pressure difference. A control adjusts the liquid metal flow rate in response to the determined liquid metal flow rate, and the liquid metal is atomized.

30 Claims, 5 Drawing Sheets

METHOD FOR ATOMIZING LIQUID METAL UTILIZING LIQUID FLOW RATE SENSOR

This application is related to copending application Ser. No. 08/028,869, filed Mar. 10, 1993.

This invention relates to an apparatus and method for atomizing liquid metal utilizing a liquid metal flow rate sensor.

BACKGROUND OF THE INVENTION

Close coupled gas atomization of liquid metal is being developed as a process for forming metal powders. The close coupled gas atomization process is performed by a nozzle comprised of a melt guide tube extending axially through a cylindrical gas plenum. The cylindrical gas plenum has an inner chamber in communication with an annular orifice, or an annular array of discrete orifices, so that a gas flow therethrough produces an atomizing gas jet which may be comprised of an array of discrete jets. The gas jet has a conical shape converging below the melt guide tube. A stream of liquid metal passing through the melt guide tube and exiting therefrom is atomized by the conical gas jet converging in the stream.

The flow rate of liquid being poured from a vessel through the atomizing nozzle is an important parameter in the atomization of liquid metals. Improved control of the atomization process can be provided with an accurate substantially instantaneous measurement of the flow rate of the liquid metal poured from the vessel. One problem that can occur during the atomization process is liquid metal freezing in the melt guide tube, herein referred to as freeze-off. A substantially instantaneous measurement of the liquid metal flow rate through the nozzle could provide a warning of impending freeze-off.

However, conventional flow rate sensors such as venturi meters and vibrating tube flow meters are unsuitable for measuring the flow rate of the high temperature liquid metals. An apparatus utilizing an eddy current sensor for measuring the flow rate of liquid metal is under investigation, see the NIST/Industrial Consortium on Intelligent Processing of Rapidly Solidified Metal Powders by Inert Gas Atomization, Semi-Annual Report, Mar. 1 to Aug. 31, 1992, National Institute of Standards and Technology, Gaithersburg, Md.

Several important properties of metal powder, and the products formed from consolidation of the powder, are dependent on the as-atomized particle size. These properties include composition homogeneity, mechanical performance, e.g. strength, and toughness, as well as physical characteristics of the powder itself, e.g., particle shape, porosity, and flow qualities. Most of these properties improve as particle size decreases, however, powder handling becomes more complicated for finer powder because of caking, environmental contamination, pyrophorosity and other affects.

The strong dependence of material properties on particle size translates into an increased demand for atomization process control that provides a predetermined particle size range, and minimizes the production of powder having a particle size above or below the predetermined range. At the same time, a number of variables necessarily change during the atomization process, such as the flow rate of molten metal through the nozzle as the static head pressure of the liquid metal in the supply vessel changes. As a result, a series of adjustments can be required during the atomization process in response to the changing variables.

An aspect of this invention is to provide an apparatus and method for atomizing liquid metal utilizing a substantially instantaneous measurement of the flow rate of the liquid metal.

BRIEF DESCRIPTION OF THE INVENTION

An apparatus for atomizing liquid metal is comprised of a vessel having an inner cavity for containing the liquid metal, the vessel having a pouring channel extending therethrough. A nozzle is coupled to the pouring channel to direct a stream of the liquid metal therethrough. The nozzle has a plenum configured for providing a jet of atomizing gas having a conical shape converging in the stream as it passes from the nozzle. A flow sensor for determining a flow rate of the stream, and a control to selectively adjust the liquid metal flow rate.

The method of this invention for atomizing liquid metal in the atomizing apparatus comprises providing a gas flow into the liquid metal. Determining a pressure difference from the gas flow. Determining a liquid metal flow rate from the pressure difference. Providing an atomizing gas to the plenum to atomize the liquid metal stream. Providing a control for adjusting the liquid metal flow rate, and selectively adjusting the control in response to the liquid metal flow rate.

BRIEF DESCRIPTION OF THE DRAWINGS

The following description of the invention will be understood with greater clarity if reference is made to the following drawings.

DETAILED DESCRIPTION OF THE INVENTION

A liquid metal flow rate sensor is used in the method and apparatus of this invention for atomizing liquid metal. The liquid metal flow rate sensor provides a substantially instantaneous measurement of the flow rate of liquid metal in the atomization process. As a result, controls for adjusting the liquid metal flow rate can be selectively adjusted in response to the measured liquid metal flow rate to provide improved process control.

Although the method and apparatus of this invention are described below using a particular atomization nozzle with an annular orifice for the atomizing gas jet, it should be recognized by those skilled in the art that the method and apparatus of this invention can be used in other atomization apparatus, such as atomizers having a nozzle with an annular array of discrete gas jets.

Figure 1:
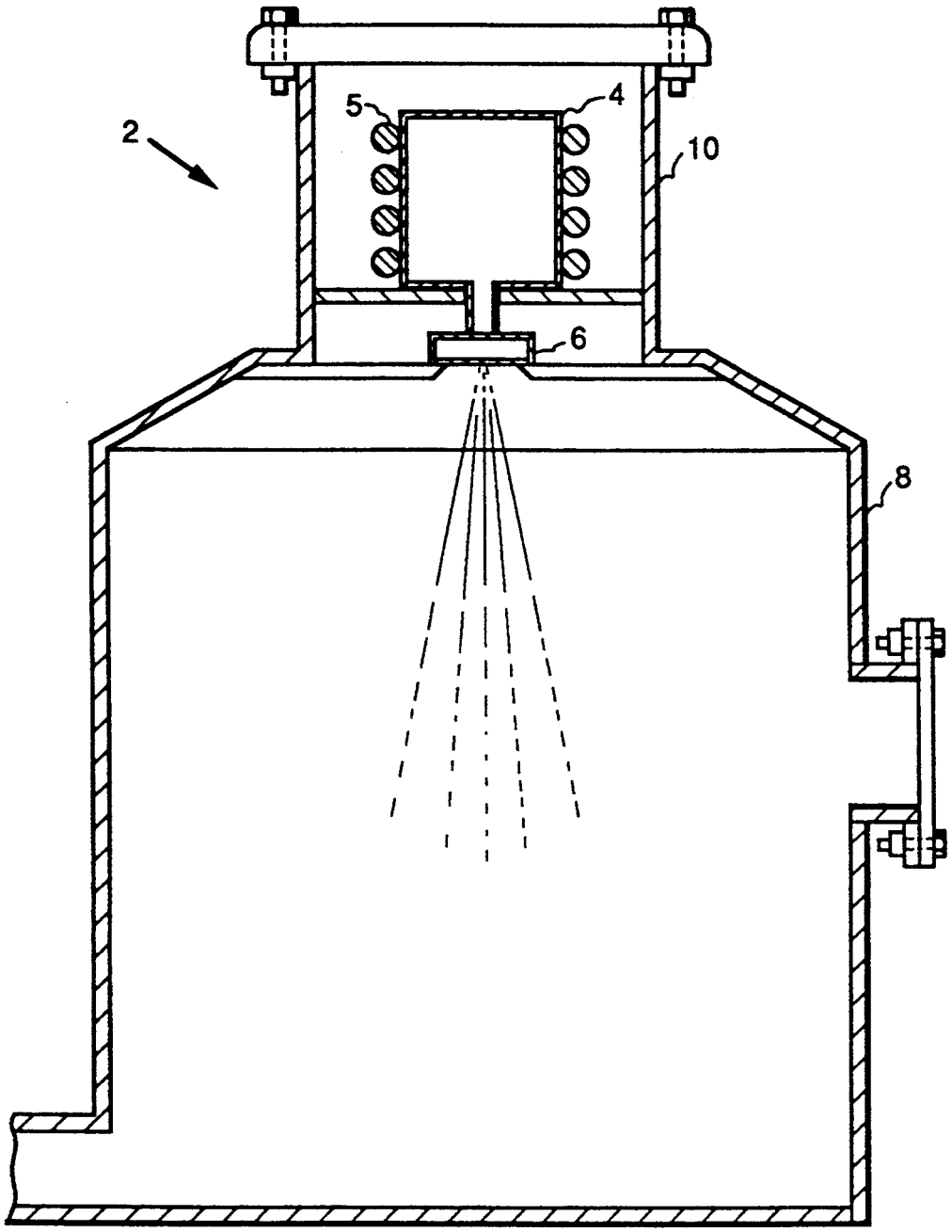
FIG. 1 is a schematic view of an apparatus for atomizing liquid metal.

Referring to FIG. 1, an apparatus 2 for atomizing liquid metal is shown. The apparatus 2 is comprised of a crucible 4, a nozzle 6, and an enclosure 8. The crucible 4 is formed of suitable material for holding the liquid metal, e.g. ceramic such as alumina or zirconia, or water cooled copper. A conventional heating means such as element 5 can be positioned for heating the molten metal therein. The molten metal in crucible 4 can be heated by any suitable means, such as an induction coil, plasma arc melting torch, or a resistance heating coil. The crucible 4 has a bottom pouring channel coupled with a melt guide tube in nozzle 6. The liquid metal is poured from the crucible 4, through the nozzle 6 conventionally mounted on atomization enclosure 8.

A suitable crucible enclosure 10 can be formed over the crucible 4 to contain an inert atmosphere for the liquid metal. A conventional gas supply means, not shown, can be coupled with the crucible enclosure 10 to provide an inert atmosphere therein. A stream of liquid metal poured from crucible 4 is directed through the nozzle 6. The nozzle 6 directs the stream of liquid metal into a jet of atomizing gas having a conical shape converging in the stream below the nozzle. The liquid metal stream is atomized by the gas jet forming a plume of molten metal droplets which are rapidly quenched to form solid particulates of the metal. A substantially instantaneous measurement of the liquid flow rate from the crucible 4 through the nozzle is an important process parameter that can be used to improve control of the process.

Figure 2:
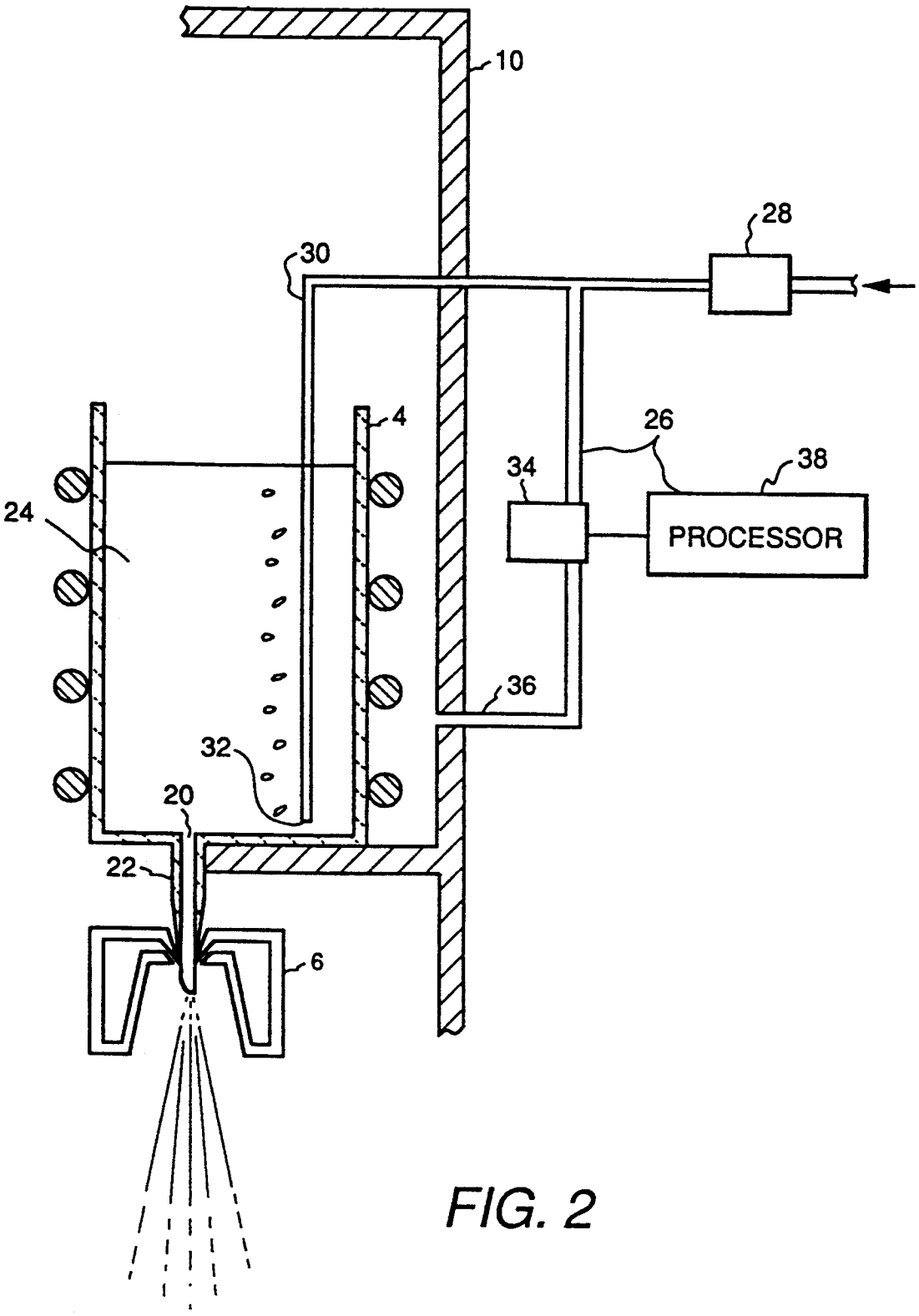
FIGS. 2–3 are each a schematic view of an apparatus for measuring the flow rate of liquid metal from a bottom pouring vessel in the atomizing apparatus.

Referring to FIG. 2, the crucible 4 defines an inner cavity 24 suitable for holding the liquid metal. A pouring channel 20 extends through the bottom of the crucible 4, and a melt guide tube 22 extends from the crucible so that the pouring channel 20 extends therethrough. A first flow sensor 26 is comprised of a conventional gas supply, not shown, coupled to a conventional gas flow regulator 28, that can regulate either the mass or volume of gas. The regulator 28 provides a first gas flow to a first tube 30 extending into the cavity 24. Preferably, the regulator 28 provides a substantially constant gas flow having minimal pressure variation in the first tube 30. At least the portion of the first tube 30 extending into the cavity 24 is formed from a material resistant to the liquid metal. For example, suitable tube materials for high melting temperature superalloys are aluminum or boron nitride, while stainless steel can be used for low melting temperature metals such as lead.

The first tube 30, preferably extends through the top of the crucible 4 into the cavity 24 to minimize liquid backing up into the tube. However, the tube 30 may extend through the sidewall of the crucible 4 into the cavity. The first tube 30 extends to a first position 32 within the cavity 24 that is below the surface of the liquid in the cavity. The cavity 24 having a cross sectional area $A_1$ at the first position 32. Preferably, the first position is at a location within the cavity spaced from the pouring channel 20 where liquid flow within the cavity is minimized during pouring, e.g., close to the sidewall of the crucible furthest from the pouring channel.

A transducer 34 is coupled with the first tube 30, and is in communication with the atmosphere in the crucible enclosure. The transducer provides an output signal proportional to the pressure difference, $p_1-p_2$, between the pressure $p_1$ of the first gas flow through the first tube 30, and the pressure $p_2$ of the atmosphere in the crucible enclosure 10. For example, a conventional inlet 36 extends through the crucible enclosure 10, and is coupled to the transducer 34. The atmosphere within the crucible enclosure 10 is in communication with the liquid metal in cavity 24. Processor 38 receives the pressure difference output signal from the transducer 34, and can determine the mass flow rate m of liquid metal from the crucible 4 according to a proportional relation $$m \propto \frac{A_1}{\rho g} \frac{d(p_1 - p_2)}{dt},$$

where g is gravity, and $\rho$ is the density of the liquid metal. It should be understood that those skilled in the art can convert the mass flow rate to the volume flow rate.

It should be understood that the single differential pressure transducer can be replaced with a first transducer coupled to the first tube, and a second transducer in communication with atmosphere in the crucible enclosure. The output signal from each transducer can be sent to the processor 38 to determine the pressure difference. The processor 38 can be comprised of a differential operating amplifier to accept the analog signals from the transducer, or a conventional microprocessor or computer having an analog to digital converter.

Preferably, the gas flow regulator 28 provides a constant gas flow rate through tube 30 sufficient to cause continuous formation and release of bubbles from the tube 30 into the liquid metal. For example, a suitable gas flow rate into the liquid metal is about 45 to 190 cubic centimeters per minute. When the gas flow rate is too low, the liquid metal can back up the tube 30, for example during transitions such as the startup of the atomizing gas. If the liquid metal penetrates to a cold portion of the first tube 30, it can solidify and block the gas flow therethrough. In addition, a low gas flow rate can cause excessive variation in the pressure of the gas flow from unstable or irregular formation of the bubbles exiting the tube 30 into the liquid metal. When the gas flow rate is too high, there can be excessive splashing from bubbles exiting the liquid metal. In addition, a high gas flow can cause the pressure drop along the length of the tube 30 to be significant enough to mask the pressure, or pressure difference being measured by the transducer.

Preferably, the first tube 30 has an inside diameter suitable to provide the continuous gas flow therethrough as discussed above, without permitting liquid to back up the tubes. For example, a suitable inside diameter is about 1 to 9 millimeters. When the inside diameter is too small, the pressure drop along the length of the tube from the continuous gas flow is too great, and the pressure changes in the gas flow from the liquid metal flow are masked. When the inside diameter is too large, the liquid metal can back up the tubes despite the continuous gas flow.

In operation, the gas flow regulator 28 provides a gas flow through the first tube 30 into cavity 24 to prevent the liquid metal from backing up the tube. The liquid metal, having a density $\rho$, is poured into the crucible 4. A stopper, not shown, is removed from the pouring channel 20, and the liquid metal is poured therethrough. The melt guide tube 22 directs the stream of molten metal from channel 20 through nozzle 6 for atomization. Regulator 28 provides the constant gas flow through the tube 30, and into the liquid metal as bubbles passing therethrough. Preferably, the gas is inert to the liquid metal.

As the level of the liquid metal in the crucible 4 decreases during the pouring, the hydrostatic pressure of the liquid metal in the cavity 24 decreases. As a result, the pressure $p_1$ of the gas flow through the tube 30 decreases. The transducer 34 provides a pressure output signal proportional to the differential pressure $p_1-p_2$ between the pressure $p_1$ in the tube 30, and the pressure $p_2$ of the atmosphere in communication with the liquid metal in the cavity 24. The processor 38 receives the output signal, and determines the mass flow rate m of the liquid metal through the pouring channel 20 according to the proportional relation, $$m \propto \frac{A_1}{\rho g} \frac{d(p_1 - p_2)}{dt}.$$

In another embodiment of the method and apparatus of this invention, a second flow sensor is configured to determine the flow rate of the liquid from the vessel, not only during steady state pouring conditions, but also during non-steady state conditions in the crucible 4 such as when the crucible is being refilled.

Figure 3:
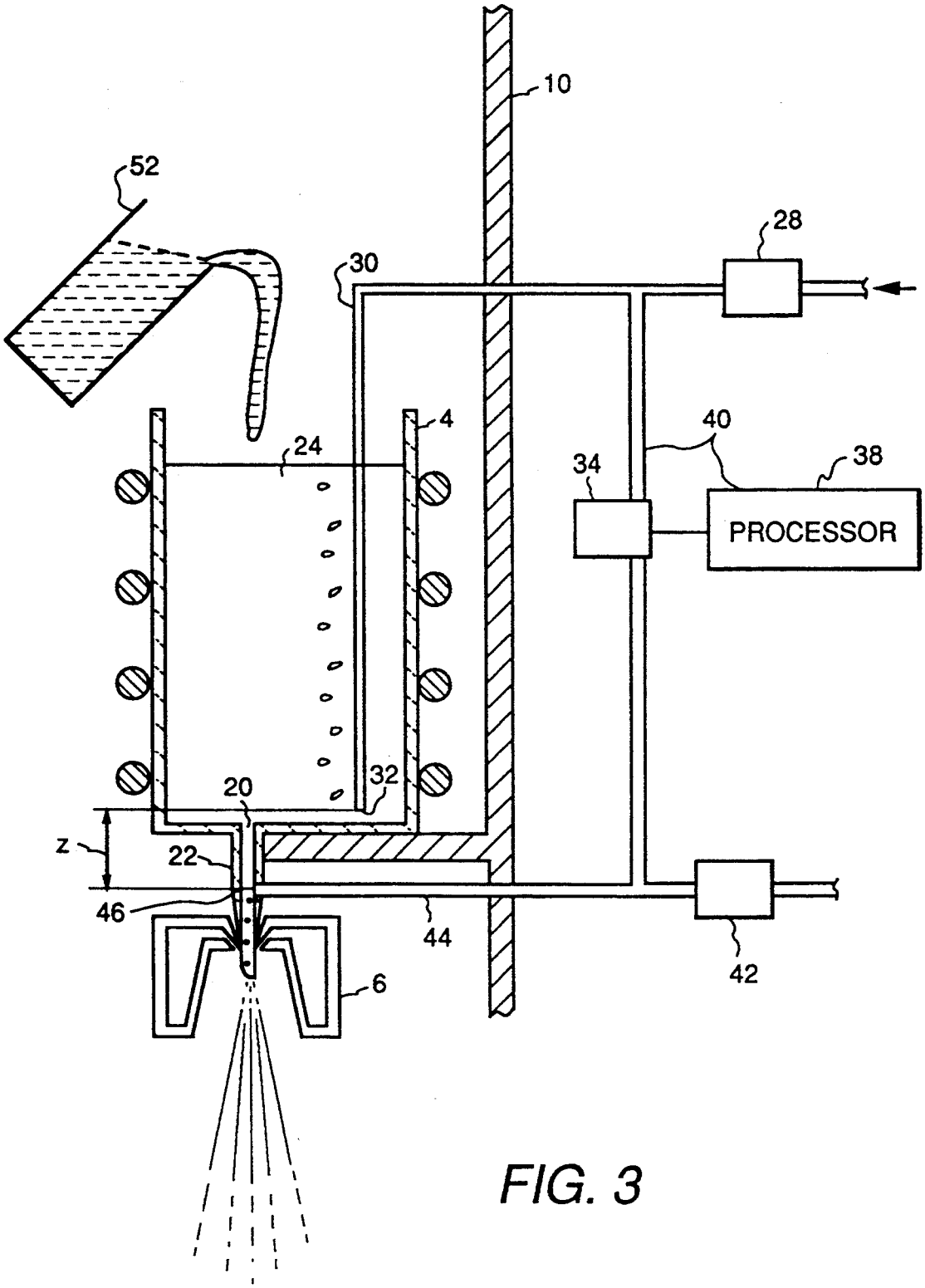

FIG. 3 shows another flow sensor for measuring the liquid metal flow rate from the crucible. Common elements in FIG. 2 and FIG. 3 are given the same numbers. The crucible 4 defines the inner cavity 24, and the bottom pouring channel 20 extending through the melt guide tube 22. The melt guide tube 22 directs the stream of molten metal into the nozzle 6 for atomization. A second flow sensor 40 provides a first gas flow into the liquid metal in the cavity 24, and a second gas flow into the liquid metal in the pouring channel 20. The second flow sensor 40 is comprised of the first and a second conventional gas supply, not shown, operatively coupled to the first and a second conventional gas flow regulator 28 and 42. The first and second regulators, respectively, provide a substantially constant gas flow to the first tube 30, extending into the cavity 24, and a second tube 44 extending into the pouring channel 20.

The first tube 30 extends to the first position 32 within the cavity 24, having the cross sectional area $A_1$. The second tube 44 extends into the pouring channel 20 at a second position 46, having a cross sectional area $A_2$ thereat. Preferably, the second position is at a location in the pouring channel where the liquid flow is substantially laminar. For example, the second position 46 can be intermediate the melt guide tube 22. The second tube extends through the melt guide tube 22 in communication with the pouring channel extending therethrough. The second tube 44 provides a second gas flow into the stream pouring through the pouring channel 20. The first and second positions are separated by a vertical distance z, i.e., the difference in depth from the top surface of the liquid in the cavity 24.

The transducer 34, for example a conventional strain gauge differential pressure transducer, is coupled in a conventional manner with the first and second tubes to measure a pressure difference $p_1$–$p_2$ between the pressure $p_1$ of the first gas flow and the pressure $p_2$ of the second gas flow. The transducer 34 provides an output signal proportional to the pressure difference $p_1$–$p_2$ of the gas flow in the first tube 30 and the second tube 44. The signal processor 38, such as the differential operating amplifier, computer or microprocessor as described above, is coupled with the transducer 34 to receive the output signals and determine the liquid metal flow rate through the pouring channel 20.

Preferably, the first and second gas flow rates are sufficient to cause continuous formation and release of bubbles from the first and second tubes into the liquid metal, as described above for the first flow sensor. Preferably, the first and second tubes have an inside diameter suitable to provide the continuous gas flow therethrough as discussed above, without permitting liquid to back up the tubes.

Preferably, the gas flow in the second tube is limited to prevent the bubbles formed in the pouring channel from interfering with the liquid metal flow rate therethrough. The inside diameter of the second tube is limited to provide for the gas flow rate that prevents liquid from backing up the tube without interfering with the liquid flow through the pouring channel. Preferably, the inside diameter of the second tube is about 7 to 25 percent, more preferably about 8 to 15 percent, of the inside diameter of the pouring channel.

In operation, the flow regulators 28 and 42 provide a gas flow through the first and second tubes into the cavity 24, and the pouring channel 20, respectively, to prevent the liquid metal from backing up the first and second tubes. A liquid metal having a density $\rho$ is poured from a melting vessel 52 into crucible 4. A stopper, not shown, is removed from channel 20, and the liquid metal is poured therethrough. The melt guide tube 22 directs the stream of molten metal from channel 20 to nozzle 6 for atomization. The gas flow regulators 28 and 42 preferably provide a constant gas flow rate into the liquid. The gas escapes from the first tube 30 and second tube 44 into the liquid metal as gas bubbles passing therethrough. Preferably, the gas is inert to the liquid metal.

As the level of the liquid metal in the crucible 4 changes from pouring or refilling, the hydrostatic pressure of the liquid metal in the cavity 24 decreases or increases. As a result, the pressure $p_1$ of the gas flow through the first tube 30 decreases or increases. Similarly, as the flow rate of liquid metal through the melt guide tube 22 changes, the pressure $p_2$ of the gas flow through the second tube 44 changes. The transducer 34 provides an output signal proportional to the pressure difference $p_1$–$p_2$ between the first tube 30 and second tube 44, respectively. The processor 38 receives the output signal, and determines the mass flow rate m of the liquid metal through the melt guide tube 22 according to a proportional relation, $$m \propto \rho A_2 \left[ \frac{2\left(\frac{(p_1 - p_2)}{\rho} + gz\right)}{\left(1 - \frac{A_2^2}{A_1^2}\right)} \right]^{\frac{1}{2}},$$

where g is gravity.

The determination of the liquid flow rate from the second flow sensor provides the flow rate independent of refilling the crucible from the vessel 52 during pouring. By assuming that the velocity of the liquid poured from the vessel 52 into the crucible 4 has been dissipated by the liquid in the crucible before the liquid passes by the first position, only gravity accelerates the liquid from the first position to the second position in the pouring channel. Assuming the liquid is inviscid, and does not compress the proportional relation can be based upon the changes in the potential energy, kinetic energy, and the work done on the liquid metal. In other words, the total energy of the liquid metal at the first position, plus the work done on the liquid metal as it passes from the first position to the second position equals the energy of the liquid metal at the second position.

Figure 4:
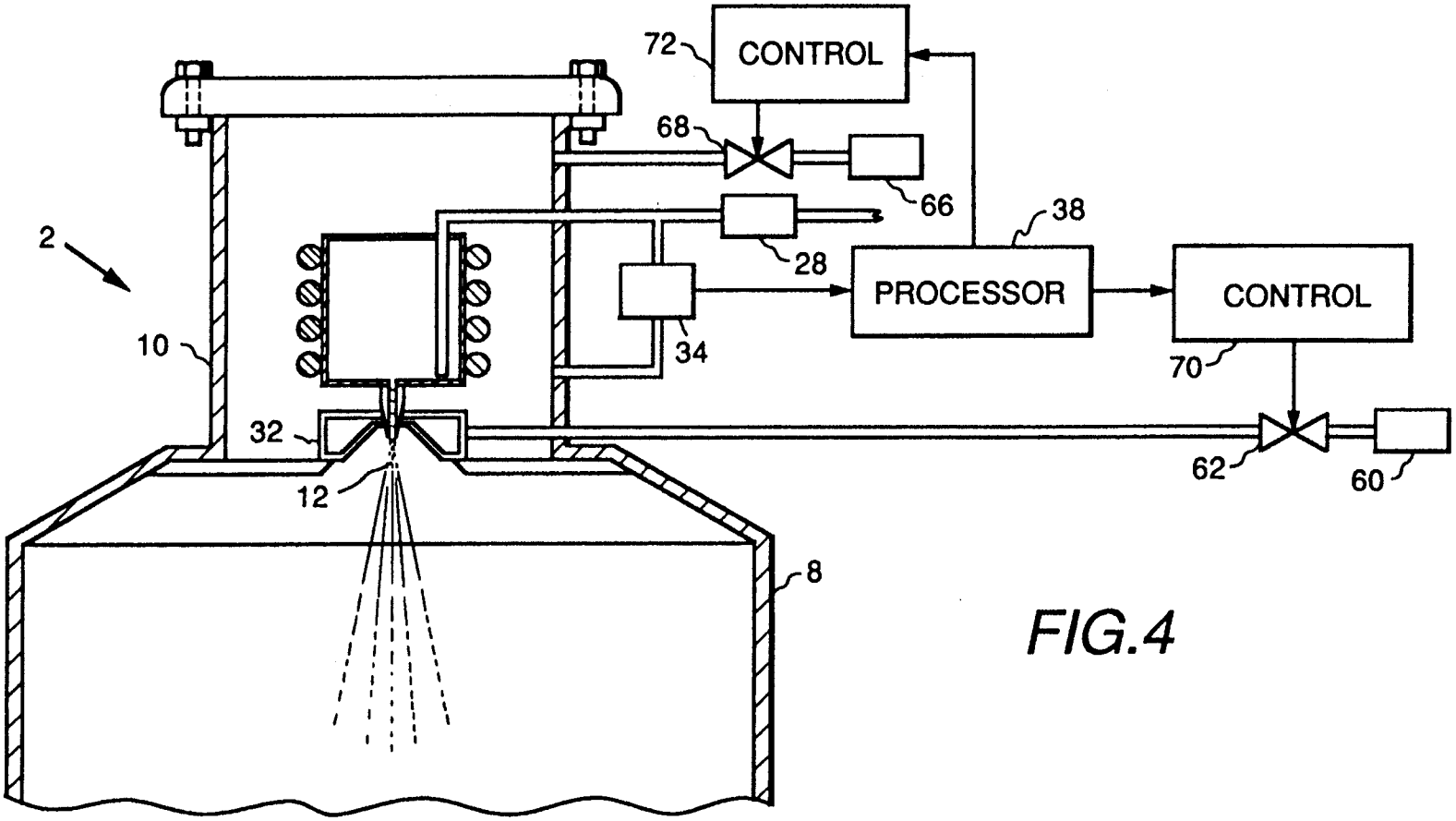
FIGS. 4–5 are each a schematic view of an apparatus for atomizing liquid metal having a liquid metal flow rate control.
Figure 5:
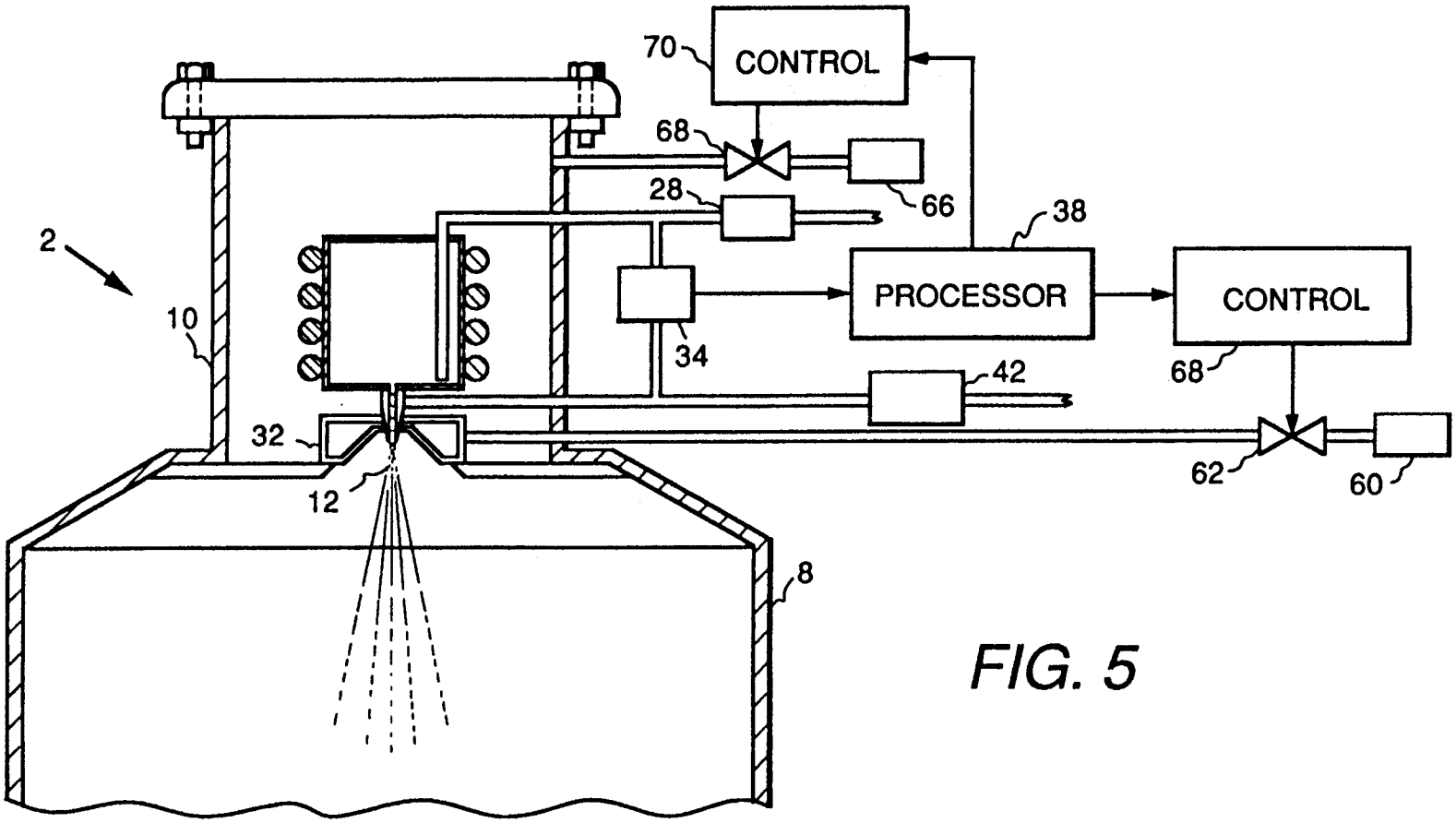

Referring to FIGS. 4 and 5, the liquid metal flow rate from the crucible 4 can be adjusted by changing the atomizing gas flow rate, or pressure in the plenum 32. For example, in a nozzle shown in copending application Ser. No. 08/028,869 (Attorney Docket RD-22,189), incorporated by reference herein, as atomizing gas pressure increases the flow rate of the liquid metal from the melt guide tube increases to a maximum and then decreases. The relation between the atomizing gas pressure or flow rate to the liquid metal flow rate can be determined for any nozzle configuration. A first control for the liquid metal flow rate is comprised of a first gas supply 60 operatively coupled to a gas inlet in the plenum 32 through a first regulator 62. The first regulator 62 can be selectively adjusted to increase or decrease the atomizing gas pressure in the plenum to provide a desired liquid metal flow rate through the melt guide tube.

A second control for the flow rate of the liquid metal stream can be provided by an ambient overpressure for the liquid metal in the crucible 4. For example, a second gas supply 66 coupled to a gas inlet in the crucible enclosure 10 through a second regulator 68 can provide the overpressure. The second regulator 68 is selectively adjusted to increase or decrease the gas pressure in the crucible enclosure 10 to provide a desired liquid metal flow rate. For example, the increased gas pressure within the crucible enclosure 10 increases the hydrostatic pressure of the liquid metal within the crucible 4. As liquid metal is poured from the crucible 4, the depth of liquid metal is reduced, reducing the hydrostatic pressure of the melt. However, the increased gas pressure within the crucible enclosure compensates for the reduced hydrostatic pressure of the melt to increase the flow rate of the liquid metal stream through the melt guide tube.

A first regulator control 70 and a second regulator control 72 are coupled to the first and second regulators, respectively. The regulators 62 and 68 can be electric or pneumatically activated by regulator controls 70 and 72 for selectively adjusting the gas supplied to the plenum 32 and crucible enclosure 10.

The processor 38 can provide an output signal proportional to the determined liquid metal flow rate m, for example to a display such as a video monitor, to display the liquid metal flow rate. An operator can manually adjust the liquid metal flow rate, for example by engaging either or both of first and second regulator controls 70 and 72 to bring the flow rate to within a desired range.

In a preferred embodiment shown in FIGS. 4 and 5, the processor 38 is coupled to the first and second regulator controls 70 and 72. The processor 38 compares the determined flow rate m to a predetermined reference value or values to determine if there is a deviation larger than a given amount. If such a deviation exists, the processor 38 is used to send a control signal to either or both of the first and second regulator controls 70 and 72 to adjust the flow rate of the liquid metal stream in order to bring the determined flow rate m back within the limits of the predetermined reference value or values.

For example, to prevent freeze-off in the nozzle, a minimum flow rate that prevents freezing is set in the processor 38. When the determined liquid metal flow rate drops below the minimum flow rate, the processor 38 sends a signal to either the first or second, or both regulator controls to provide an atomizing gas pressure or overpressure in the crucible enclosure that increases the liquid metal flow rate.

What is claimed is:

1. A method for controlling the melt flow rate of a melt when atomizing liquid metal comprising the steps of:

providing a liquid metal supply vessel coupled to a nozzle for directing a stream of the liquid metal therefrom;

providing atomizing gas converging in the stream as it exits the nozzle;

providing at least one gas flow into the liquid metal contained in the vessel;

sensing a pressure difference between the gas flow and the pressure outside the vessel;

calculating a flow rate of the stream from the pressure difference;

providing a flow control, operatively connected to the gas flow in the liquid melt vessel, for adjusting the flow rate of the stream; and selectively adjusting the flow control in response to the determined pressure difference.

2. The method of claim 1 wherein the gas flow is at a rate of about 45 to about 190 cubic centimeters per minute.

3. The method of claim 2 wherein the liquid metal has a density $\rho$, the liquid metal supply vessel has an inner cavity for holding the liquid metal, the gas flow is at a first position in the cavity having a cross-sectional area $A_1$, the pressure difference being the difference between a gas pressure $p_1$ of the gas flow and an atmosphere pressure $p_2$ of atmosphere in communication with the liquid metal in the vessel, the stream flow rate m being determined according to a proportional relation, $$m \propto \frac{A^1}{\rho g} \quad \frac{d(p_1 - p_2)}{dt}$$

where g is gravity.

4. The method of claim 2 wherein the liquid metal has a density $\rho$, the liquid metal supply vessel has an inner cavity for holding the liquid metal and a pouring channel extending through a melt guide tube in the nozzle, wherein the step of providing at least one gas flow further comprises:

providing a first gas flow to a first position in the cavity having a cross-sectional area $A_1$ and a second gas flow to a second position in the pouring channel having a cross-sectional area $A_2$, a vertical distance z being the distance between the first and second positions, the pressure difference being the difference between a first pressure $p_1$ of the first gas flow and a second pressure $p_2$ of the second gas flow, where the stream flow rate m is determined according to the following proportional relation, $$m \propto \rho A_2 \left[ \frac{2\left(\frac{(p_1 - p_2)}{\rho} + gz\right)}{\left(1 - \frac{A_2^2}{A_1^2}\right)} \right]^{\frac{1}{2}}$$

where g is gravity.

5. The method of claim 3 wherein the flow control is operatively connected to a supply of atomizing gas.

6. The method of claim 3 wherein the flow control is operatively connected to an atmosphere overpressure system in communication with the liquid metal in the vessel.

7. The method of claim 3 wherein the flow control is operatively connected to a supply of atomizing gas and an atmosphere overpressure system in communication with the liquid in the vessel.

8. The method of claim 4 wherein the flow control is operatively connected to a supply of atomizing gas.

9. The method of claim 4 wherein the flow control is operatively connected to an atmosphere overpressure system in communication with the liquid metal in the vessel.

10. The method of claim 4 wherein the flow control is operatively connected to a supply of atomizing gas, and an atmosphere overpressure system in communication with the liquid in the vessel.

11. In a liquid metal atomizing system comprising an enclosure including a vessel containing a supply of the liquid metal operatively connected to a nozzle for directing a stream of the liquid metal into an atomization zone below the nozzle, a method for controlling the flow rate of the liquid metal through the nozzle to the atomization zone comprising the steps of:

providing a regulated gas flow via a first tube, operatively positioned in the vessel, having an open end positioned below the level of the liquid metal in the vessel;

providing means for sensing the pressure inside the enclosure and the pressure of the gas flowing in the first tube;

measuring the difference between the sensed pressures; and determining the mass flow rate of the liquid metal from the nozzle into the enclosure.

12. The method of claim 11, wherein the regulated gas is provided at a flow rate of about 45 to about 190 cubic centimeters per minute.

13. The method of claim 11, wherein the regulated gas has a flow rate sufficient to prevent the liquid metal from backing up in the first tube during operation of the atomizing system.

14. The method of claim 11, wherein the regulated gas has a flow rate sufficient to eliminate excessive vibration due to unstable or irregular formation of bubbles exiting the tube into the liquid metal.

15. The method of claim 11, wherein the regulated gas flow rate is sufficient to maintain flow through the liquid metal but insufficient to cause excessive splashing from bubbles exiting the liquid metal.

16. The method of claim 11, wherein the tube has an inside diameter of about 1 to about 9 millimeters.

17. The method of claim 11, and wherein the tube has an inside diameter that is sufficient to prevent the pressure drop along the length of the tube from the continuous gas flow from being too large.

18. The method of claim 11, wherein the gas tube has an inside diameter sufficient to prevent backup of the liquid metal in the tube despite the presence of continuous gas flow.

19. The method of claim 11, further comprising the step of:

providing means for sensing a second gas flow in a stream of molten metal in the nozzle.

20. In a liquid metal atomizing system comprising an enclosure including a vessel containing a supply of the liquid metal operatively connected to a nozzle for directing a stream of the liquid metal into an atomization zone below the nozzle, a method for controlling the flow rate of the liquid metal through the nozzle to the atomization zone comprising the steps of:

providing a regulated gas flow via a first tube, operatively positioned in the vessel, having an open end positioned below the level of the liquid metal in the vessel;

providing a second gas flow via a second tube operatively connected to the pouring channel and to a gas regulator;

determining the pressure of the first and second gas flows;

calculating the pressure difference between the first gas flow and the second gas flow; and adjusting the flow rate of the stream based upon the calculated difference in pressures.

21. The method of claim 20, wherein the inside diameter of the second tube is sufficient to provide for the gas flow rate and to prevent liquid from backing up the tube without interfering with the liquid flow through the pouring channel.

22. The method of claim 20, wherein the inside diameter of the second tube is about 7 to about 25 percent of the inside diameter of the pouring channel.

23. The method of claim 20, wherein the inside diameter of the second tube is about 8 to about 15 percent of the inside diameter of the pouring channel.

24. The method of claim 20, wherein utilization of the second tube flow rate allows the stream flow rate to be calculated independently of refilling the crucible from the vessel during atomization.

25. A method of preventing freeze-off in the nozzle of a gas atomization apparatus, the apparatus comprising:

an enclosure;

a holding crucible for liquid metal positioned inside the enclosure;

heating means, operatively positioned relative to the crucible, for heating the liquid metal;

a pouring channel operatively connected to the crucible: and a nozzle having a melt guide tube, operatively connected to the pouring channel, for delivering a stream of liquid metal to an atomization zone, the method comprising the steps of:

providing a first gas flow, operatively connected to a plenum and a first adjustable regulator, for selectively adjusting the atomizing gas pressure in the plenum so that a desired liquid flow rate through the melt guide tube is achieved; and providing an ambient overpressure for the liquid metal in the crucible inside the enclosure, operatively connected to a second adjustable regulator, for selectively adjusting the gas pressure in the crucible enclosure such that a desired flow rate through the melt guide tube is achieved.

26. The method of claim 25, wherein as liquid metal exits the crucible through the melt guide tube, the hydrostatic pressure of the melt is reduced, the pressure within the crucible enclosure is increased to compensate therefore such that the desire flow rate of the liquid metal stream through the melt guide tube is maintained regardless of the depth of the liquid in the crucible.

27. The method of claim 25, and further comprising the step of:

providing a processor for displaying an output signal of the determined liquid metal flow rate through the melt guide tube.

28. The method of claim 27, further comprising the step of:

adjusting the liquid metal flow rate by adjusting either or both of the first and second regulators to bring the flow rate within a desired range.

29. The method of claim 28, wherein when the determined liquid metal flow rate drops below a minimum flow rate predetermined as a minimum flow rate impending freeze-off, the processor communicates to either the first or second, or both regulators the need to provide atomizing gas pressure or overpressure in the crucible enclosure to increase the liquid metal flow rate through the melt guide tube.

30. In a liquid metal atomizing system comprising an enclosure including a vessel containing a supply of the liquid metal operatively connected to a nozzle for directing a stream of the liquid metal into an atomization zone below the nozzle, a method for controlling the flow rate of the liquid metal through the nozzle to the atomization zone comprising the steps of:

providing a regulated gas flow, operatively connected to a plenum through a first regulator, for selectively adjusting the atomizing gas pressure in the plenum;

providing an ambient overpressure in the enclosure operatively connected to a regulator;

providing means to sense the atomizing gas pressure and the ambient overpressure;

determining the overpressure and the atomizing gas pressure;

determining the actual flow rate of the stream;

comparing the determined flow rate to a reference value; and adjusting the flow rate of the stream based upon the calculated difference therebetween.

* * * * *